United States Patent [19]

Trocciola et al.

[11] Patent Number: 4,596,638

[45] Date of Patent: Jun. 24, 1986

[54] METHOD FOR THE ELECTROCHEMICAL PRODUCTION OF ADIPONITRILE USING ANODES HAVING $NICO_2O_4$ CATALYST

[75] Inventors: John C. Trocciola, Glastonbury; Douglas A. Landsman, Hartford, both of Conn.

[73] Assignee: International Fuel Cells Corporation, South Windsor, Conn.

[21] Appl. No.: 727,472

[22] Filed: Apr. 26, 1985

[51] Int. Cl.[4] ..... C25B 3/00

[52] U.S. Cl. ..... 204/73 A; 204/73 R; 204/290 R

[58] Field of Search ..... 204/73 A, 73 R, 290 R

[56] References Cited

U.S. PATENT DOCUMENTS

| | | | |
|---|---|---|---|
| 3,427,234 | 2/1969 | Guthke | 204/73 A |
| 3,607,416 | 9/1971 | Sizer et al. | 429/34 |
| 3,657,099 | 4/1972 | Seko et al. | 204/253 |
| 3,661,739 | 5/1972 | Tomilov et al. | 204/73 A |
| 3,682,793 | 8/1972 | Seko et al. | 204/73 A |
| 3,837,712 | 9/1974 | Grosseau | 303/117 |
| 4,039,417 | 8/1977 | Sasaki et al. | 204/197 |
| 4,076,611 | 2/1978 | Gray | 204/290 F |
| 4,132,619 | 1/1979 | Klein et al. | 204/242 |
| 4,187,155 | 2/1980 | de Nora et al. | 204/67 |
| 4,391,668 | 7/1983 | Armstrong | 204/290 R |
| 4,416,758 | 11/1983 | Tseung | 204/290 R |

FOREIGN PATENT DOCUMENTS

| | | |
|---|---|---|
| 813877 | 5/1969 | Canada . |
| 1251899 | 11/1971 | United Kingdom . |

*Primary Examiner*—John F. Niebling

*Attorney, Agent, or Firm*—A. Dean Olson

[57] ABSTRACT

Anodes having $NiCo_2O_4$ catalyst used in the electrohydrodimerization of acrylonitrile to adiponitrile result in anode voltage requirements of less than about 2000 millivolts at 100 milliamperes per square centimeter of anode area. Typically, oxygen evolving anodes comprised of lead or carbon steel are utilized in the hydrodimerization of acrylonitrile to adiponitrile resulting in high voltage requirements. Anodes containing $NiCo_2O_4$ catalyst require substantially reduced voltages and perform well in the conventional electrochemical adiponitrile production environment.

4 Claims, 1 Drawing Figure

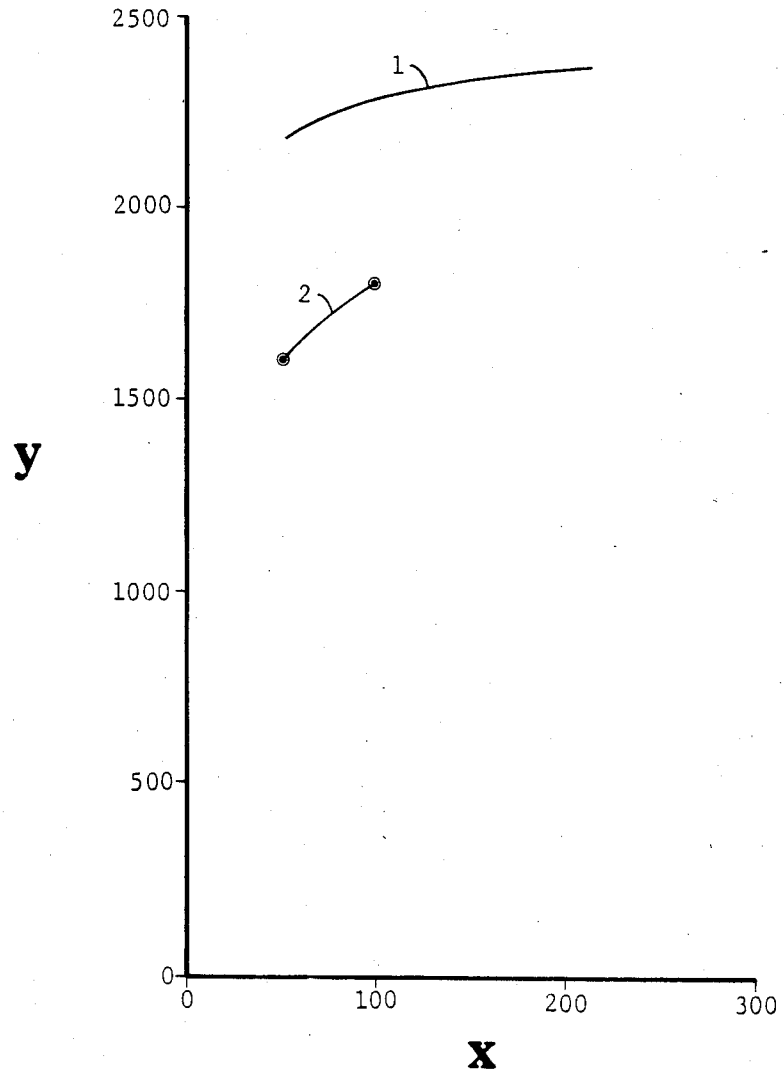
2500
2000
1500
1000
500
0
y
1
2
0
100
200
300
x

METHOD FOR THE ELECTROCHEMICAL PRODUCTION OF ADIPONITRILE USING ANODES HAVING $NiCo_2O_4$ CATALYST

DESCRIPTION

1. Technical Field

The field of art to which this disclosure pertains is electrolysis processes for synthesizing organic compounds, and particularly methods of producing adiponitrile.

2. Background Art

Adiponitrile is utilized extensively in the manufacture of Nylon 66-type synthetic fibers, and in several other organic synthesis processes.

One of the simplest known methods for the preparation of adiponitrile involves the hydrodimerization of acrylonitrile. In the electrolysis process, adiponitrile is produced at the cathode and oxygen is evolved at the anode. Empirically this can be illustrated as:

(Cathode Reaction) $2CH_2CHCN+2H_2O+2e^- \rightarrow NC(CH_2)_4CN+2OH^-$ (Anode Reaction) $2OH^- \rightarrow \frac{1}{2}O_2+H_2O+2e^-$ The full thermodynamic electrochemical conversion efficiency is never realized in a practical electrochemical cell such as that illustrated above. Thus a voltage greater than the theoretical voltage has to be applied to the cell to overcome various polarizations, e.g., the ohmic resistance of the cell, the back e.m.f. generated by consumption of reactants and generation of products and activation polarization due to irreversibility of the electrode reactions.

Typically the anode reaction, oxygen evolution, is carried out using a carbon steel anode and is characterized by high polarizations which can amount to 0.8 volt or more. These polarizations result in significant cell power consumption (IE).

Accordingly, there is a constant search in the art for processes that electrohydrodimerize acrylonitrile to produce adiponitrile that result in reduced cell power consumption.

DISCLOSURE OF INVENTION

This discovery is directed at a low energy method of hydrodimerizing acrylonitrile to produce adiponitrile in an electrochemical cell. The cells contain an anode, a cathode, and aqueous electrolyte. The electrolyte solution is maintained in contact with the cathode and the anode. A supply of acrylontitrile is maintained at the cathode and a supply of hydroxyl ions are maintained at the anode. A direct electric current is passed through the system causing acrylonitrile to be hydrodimerized to adiponitrile at the cathode and hydroxyl ions to be oxidized at the anode. The anode of this invention is comprised of a layer of $NiCo_2O_4$ that contains fluorocarbon polymer bonded to an electrically conductive substrate. This process results in an anode voltage requirement of less than about 2000 millivolts (mv) at 100 milliamperes per square centimeter ($ma/cm^2$) of anode area.

This discovery provides a significant advancement to electrochemical technology, particularly the adiponitrile industry. Electrochemical processes that utilize anodes containing $NiCo_2O_4$ catalyst for the hydrodimerization of acrylonitrile to adiponitrile require lower anode voltages resulting in significant energy savings.

Other features and advantages will be apparent from the specification and claims and from the accompanying drawing which illustrates an embodiment of this invention.

BRIEF DESCRIPTION OF DRAWING

The FIGURE illustrates comparative voltages for anodes containing $NiCo_2O_4$ catalyst of the present invention and anodes typical of the prior art.

BEST MODE FOR CARRYING OUT THE INVENTION

Generally any conductive electrode material compatible with the acrylonitrile electrohydrodimerization system and an oxygen evolution environment can be used to make the anode substrate, preferably an electrically conductive material. It is especially preferred that the substrate is a metal substrate such as a nickel, stainless steel, carbon steel, copper, lead, cadmium, zinc, or copper substrate. It is especially preferred that carbon steel be used. Optionally, the substrate is wetproofed with from about 2 to about 10 milligrams per square centimeter ($mg/cm^2$) of polytetrafluoroethylene (PTFE polymers, Dupont DeNemours, Inc.) or fluorinated ethylenepropylene. Typically the substrate has the form of a sheet with a plurality of holes, preferably a screen material, although flat sheets of metal are also suitable. Conventional substrates are about 5 mils to about 20 mils in thickness. Conventional mesh sizes range from as low as about 50 mesh to as high as about 200 mesh preferably about 100 mesh. Mesh refers to the number of wires per linear inch in each axis. The metal substrate can be made by conventional methods and may also be purchased as 1020 carbon steel #100 mesh screen from Cleveland, Wire and Cloth Manufacturing, Cleveland, Ohio.

The conductive electrode substrate supports a $NiCo_2O_4$-binder layer typically referred to as the catalyst layer. Generally any binder that is compatible with the acrylonitrile electrohydrodimerization system can be used, preferably a fluorocarbon polymer with a molecular weight greater than $10^6$. It is especially preferred that the binder is PTFE. Generally the mixture is about 20 weight percent (%) to about 80% binder, preferably 25%, and about 80% to about 20% catalyst, preferably 75%. The catalyst loading is about 10 $mg/cm^2$ to about 50 $mg/cm^2$, preferably about 20 $mg/cm^2$ of anode area. Typical catalyst layers are about 1 mil to about 5 mils, preferably about 2.5 mils in thickness, and the mean pore diameter is about 0.1 micron ($\mu$) to about 8$\mu$, preferably about 0.5$\mu$.

The substrate and catalyst layer form a conventional gas diffusion electrode that can be made by methods known to those skilled in the art. However, the $NiCo_2O_4$ powder may be prepared by several different methods. Thermal decomposition of mixed nitrates of nickel and cobalt is the most common method. Thus the anode described above may be made by first intimately mixing appropriate amounts of an aqueous dispersion of $NiCo_2O_4$ powder and an aqueous dispersion of PTFE polymer. The mixed solids, depending on the consistency of the codispersion, may then be deposited on the substrate by a spraying, filtering or printing process.

A particularly advantageous procedure is to add a flocculating agent to the codispersion which causes the suspended solids to coagulate. The resulting coprecipitate is filtered onto filter paper and the filter coke is transferred by pressure to the screen substrate.

After drying and compacting the catalyst layer, the electrode is finally heated in air for ten minutes at a temperature between 320° C. and 350° C. to cure (i.e. sinter) the PTFE polymer and bind the structure together.

The anodes described above are utilized in conjunction with conventional cathodes used for the electrohydrodimerization of acrylonitrile to adiponitrile. These cathodes include electrodes made from lead, cadmium, zinc, carbon steel, titanium, nickel and copper.

The electrolyte systems are conventional and include such electrolytes as a $Na_2HPO_4$ based system, which typically has a pH between 7 and 10, and a sulfuric acid based system. It is also conventional to use a different electrolyte composition at the anode compartment than is used at the cathode compartment. Typically, additives such as corrosion inhibitors can be added to the electrolyte system. In addition, typical cells operate at 54° C.

Any good commercial grade of acrylonitrile is suitable for electrohydrodimerization including acrylonitrile available from Monsanto Corporation.

Conventional electrochemical cells and electrohydrodimerization processes are described in *Adiponitrile via Improved EHD,* D. E. Danly, Hydrocarbon Processing, April 1981, which is incorporated by reference. In this process the electrolyte solution is maintained in contact with both electrodes in order to complete the electrical circuit. In the adaptation of this process as disclosed in this application, hydroxyl ions are supplied to the anode utilizing technology conventional to the fuel cell art, such as diffusion through the electrolyte from the cathode compartment. Acrylonitrile is supplied to the cathode by conventional means, for example, by circulating a fluid stream containing acrylonitrile, water, and dissolved salts to the cathode compartment of the reaction cell. Oxygen is evolved from the anode by the oxidation of hydroxyl ions. It is preferred that the acrylonitrile be continually supplied to the respective cathode as the electrolysis products are removed, resulting in a continuous vs. a batch process. When electric currents of about 20 ma/cm$^2$ to about 250 ma/cm$^2$ are passed across the electrodes, electrolysis occurs. At the cathode acrylonitrile is hydrodimerized to adiponitrile with the coproduction of hydroxyl ions; empirically this is illustrated as $CH_2CHCN+2H_2O+2e^- \rightarrow NC(CH_2)_4CN+2OH^-$. At the anode of this invention, the hydroxyl ions are oxidized to produce oxygen. This can be empirically illustrated as $2OH^- \rightarrow \frac{1}{2}O_2+H_2O+2e^-$. Typical yields based on adiponitrile range between about 60% to about 90%.

EXAMPLE

A Pyroceram TM (Corning Glass Works Co.) dish was placed in an oven located in a vented fume hood and heated to 350° C. 29 grams $Ni(NO_3)_2 6H_2O$ and 58 grams $Co(NO_3)_2 6H_2O$ were added to a beaker and melted at 135° C. for approximately 30 minutes. The melted solution was poured quickly onto the 350° C. Pyroceram dish which was heated in air for a further 2½ hours at 350° C. It was then allowed to cool and the product was sifted through a 100 mesh screen and heat treated for an additional 2 hours at 350° C. This process yielded a fine black powder of composition $NiCo_2O_4$.

Three grams of the $NiCo_2O_4$ were blended ultrasonically with 80 milliliters (mls) water at 200 watts for two minutes. 1.0 gram (on a dry solids basis) of PTFE T-30 polymer (Dupont de Nemours, E.I., Co.) solution was added and blending continued for one minute. The blended solids were transferred by a filter-transfer process onto a carbon steel 100 mesh screen measuring 12.5 centimeter (cm.) by 12.5 cm. After drying at 120° C. and pressing at 400 psi, the electrode was sintered at 321° C. for 10 minutes in air. This electrode was tested in an aqueous solution comprising 10% $Na_2HPO_4$, 3.8% $Na_2B_4O_7$. 1O $H_2O$, and 0.4% ethyldibutyl ammonium phosphate. A test of the electrode in a typical electrolyte solution used in a electrohydrodimerization process is sufficient to demonstrate the effectiveness of an electrohydrodimerization process that utilizes that anode, as the anode is independent of the rest of the cell. The results are incorporated in the FIGURE, curve 2.

In the FIGURE the X axis represents cell current density in ma/cm$^2$ of electrode. This is plotted against anode voltage (y) in mv. The anode voltage is not an absolute term, it is measured against a hydrogen/-platinum reference electrode (HRE) in the same solution. The voltage of the HRE is assumed to be zero. The point 1.23 volts is the theoretical voltage required to evolve oxygen from the anode. Curve 1 illustrates the actual voltage required to evolve oxygen from a conventional carbon steel electrode in a solution of $Na_2HPO_4$ the typical electrolyte used in cells which produce adiponitrile by the electrohydrodimerization of acrylonitrile. The oxygen evolution data curve 1 was taken from the Danly article referenced above. The difference between the curve and 1.23 volts is the polarization which is defined as the excess of the observed decomposition voltage over the theoretical reversible decomposition voltage. In contrast to curve 1, curve 2 illustrates the voltages required for an oxygen evolving anode containing $NiCo_2O_4$ in a similar electrolyte solution. For instance, at 100 ma/cm$^2$ of electrode area there is a voltage requirement of less than about 2000 millivolts. A comparison of curve 2 and curve 1 at a specific current density clearly illustrates the lower voltages required by the $NiCo_2O_4$ containing anode.

These cells make a significant contribution to electrochemical technology, particularly the adiponitrile industry by incorporating energy saving anodes containing $NiCo_2O_4$ catalyst. The power consumption for the electrohydrodimerization of acrylonitrile to adiponitrile depends on the voltages required for the anode and cathode reactions and the electrode resistance losses. Typical anodes used in the hydrodimerization processes require close to 2.2 volts at 100 ma/cm$^2$. By contrast, the hydrodimerization processes of this invention incorporates anodes requiring voltages of close to 1.8 volts, a savings of about 0.4 volt.

These reduced voltages result in significant energy savings for electrohydrodimerization processes. Although the anodes of this invention require $NiCo_2O_4$ as a catalyst, this particular catalyst may be synthesized from a readily available metal salts. In addition, this catalyst contains no noble metals unlike other commercial electrode systems resulting in a cost effective electrode. Thus electrochemical technology relating to adiponitrile production has been advanced by the discovery of processes that incorporate energy saving electrodes.

It should be understood that the invention is not limited to the particular embodiments shown and described herein, but that various changes and modifications may be made without departing from the spirit and scope of this novel concept as defined by the following claims.

We claim:

1. A method of hydrodimerizing acrylonitrile to produce adiponitrile in an electrochemical system in cells that contain aqueous electrolyte, an anode and a cathode comprising:

(a) maintaining aqueous electrolyte in contact with the cathode and the anode;

(b) maintaining a supply of acrylonitrile at the cathode;

(c) maintaining a supply of hydroxyl ions at the anode; and (d) passing a direct electric current through said system causing hydrodimerization of the acrylonitrile to adiponitrile at the cathode and oxidation of the hydroxyl ion to oxygen at the anode;

wherein the improvement comprises utilizing as the anode a polytetrafluoroethylene containing $NiCo_2O_4$ layer bonded to an electrically conductive substrate requiring an anode voltage of less than about 2000 millivolts at 100 milliamperes per square centimeter of anode area.

2. The method as recited in claim 1 wherein the electrically conductive substrate is a carbon steel substrate.

3. the method as recited in claim 1 wherein the layer comprises about 25% polytetrafluoroethylene binder and about 75% $NiCo_2O_4$ catalyst.

4. The method as recited in claim 1 wherein the electrolyte is disodium hydrogen phosphate.

* * * * *